United States Patent [19]

Barth

[11] Patent Number: 4,844,228

[45] Date of Patent: Jul. 4, 1989

[54] COIN HOLDING MECHANISM FOR COIN OPERATED LOCKER

[75] Inventor: Douglas A. Barth, Alleghany, N.Y.

[73] Assignee: American Locker Group Incorporated, Jamestown, N.Y.

[21] Appl. No.: 164,391

[22] Filed: Mar. 4, 1988

[51] Int. Cl.[4] ..... G07F 17/12

[52] U.S. Cl. ..... 194/290; 194/344

[58] Field of Search ..... 194/237, 290, 344, 346, 194/351; 70/DIG. 1, 129, 340; 292/143

[56] References Cited

U.S. PATENT DOCUMENTS

| | | | |
|---|---|---|---|
| 1,933,263 | 10/1933 | Hofmann | 194/290 |
| 2,580,590 | 1/1952 | Polsen et al. | 194/344 |
| 2,684,144 | 7/1954 | Beimel | 194/290 |
| 3,037,605 | 6/1962 | Stackhouse | 194/290 |
| 3,193,074 | 7/1965 | Stackhouse | 194/290 |
| 3,228,506 | 1/1966 | Stackhouse | 194/290 |
| 3,269,507 | 8/1966 | Smith et al. | 194/344 X |
| 3,599,770 | 8/1971 | Stackhouse et al. | 194/290 |

*Primary Examiner*—Joseph J. Rolla
*Assistant Examiner*—Edward S. Ammeen
*Attorney, Agent, or Firm*—Bean, Kauffman & Spencer

[57] ABSTRACT

A coin holding mechanism is adapted for use in new coin operated lock units and in retrofitting previously installed lock units of the type adapted for "free" service in order to prevent return of a coin deposit to a patron until the lock unit is in a condition wherein a key operated patron lock cannot be placed/returned to locked position in which the key of the patron lock can be removed in the absence of another coin being properly placed on deposit within the lock unit.

7 Claims, 2 Drawing Sheets

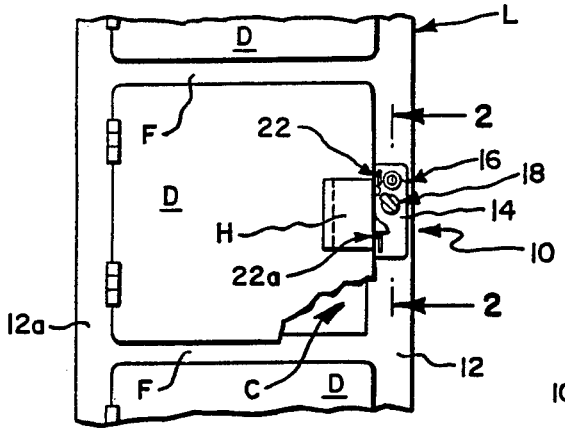
Fig. 1.
Fig. 3.
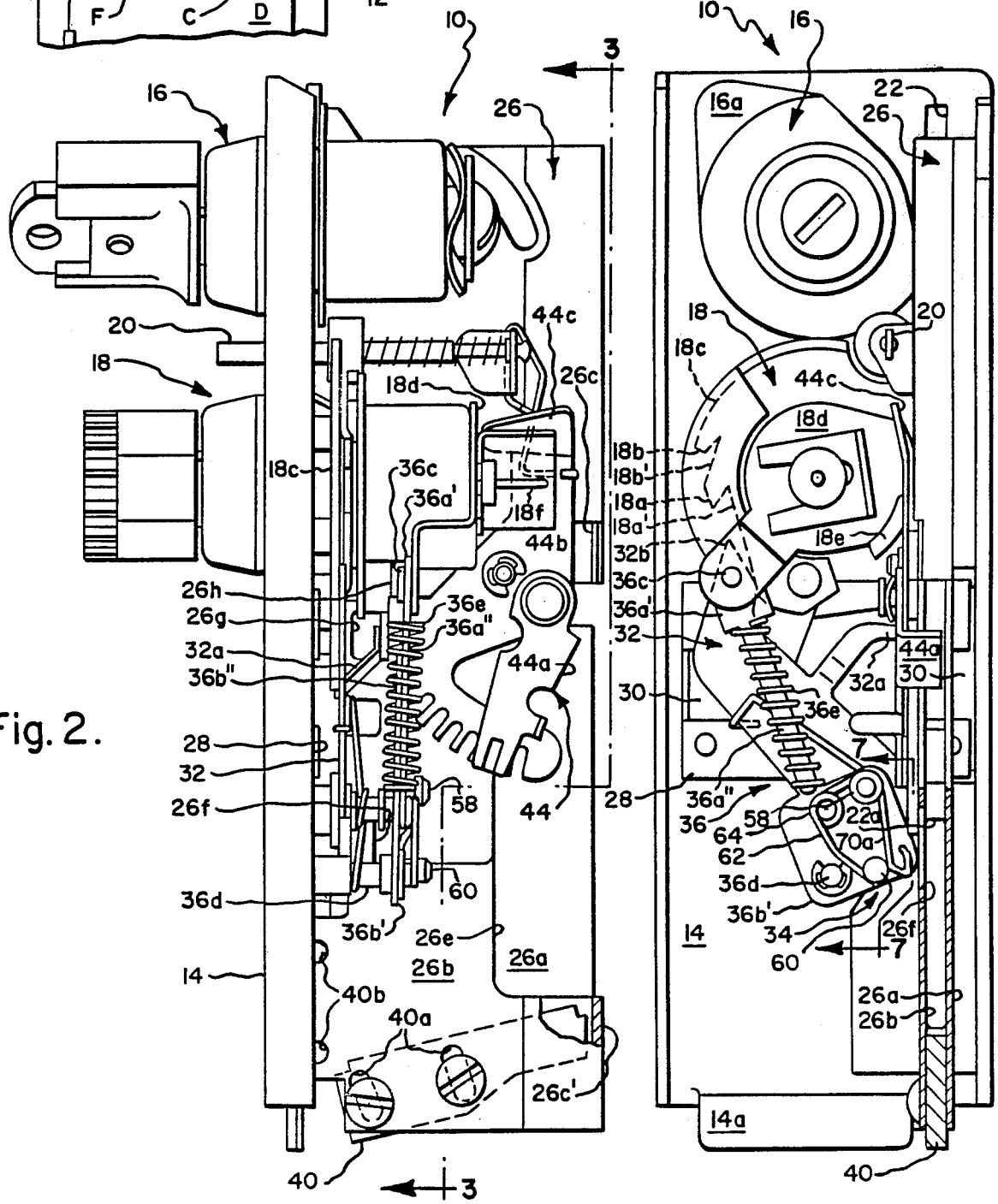
Fig. 2.

Fig. 4.
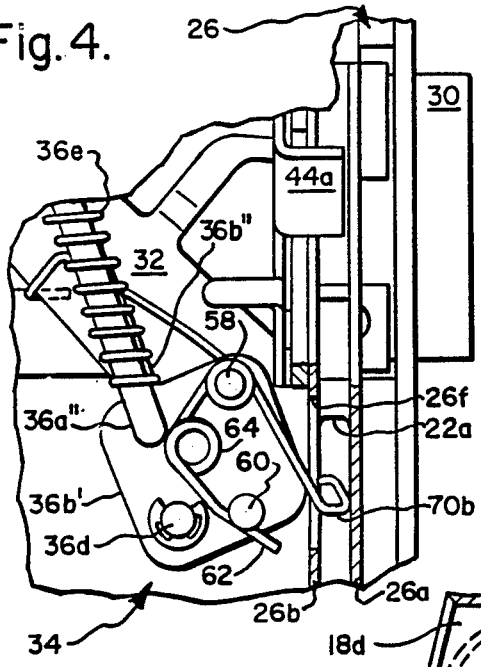
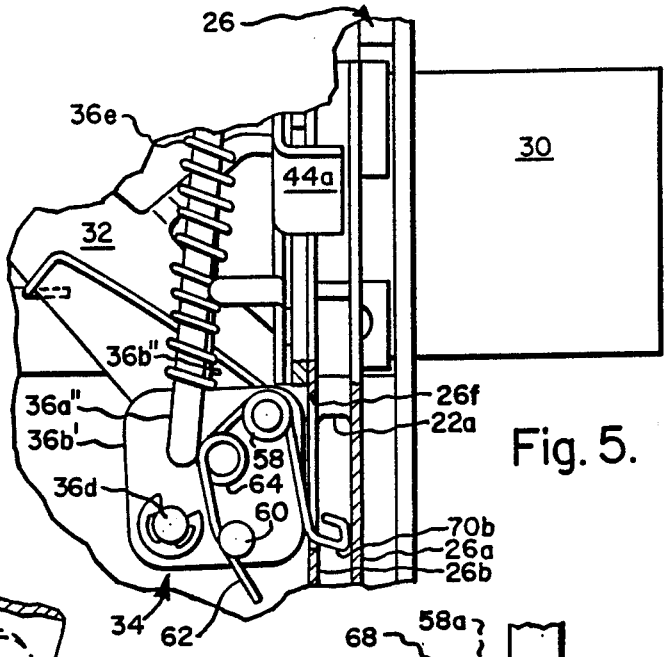
Fig. 5.
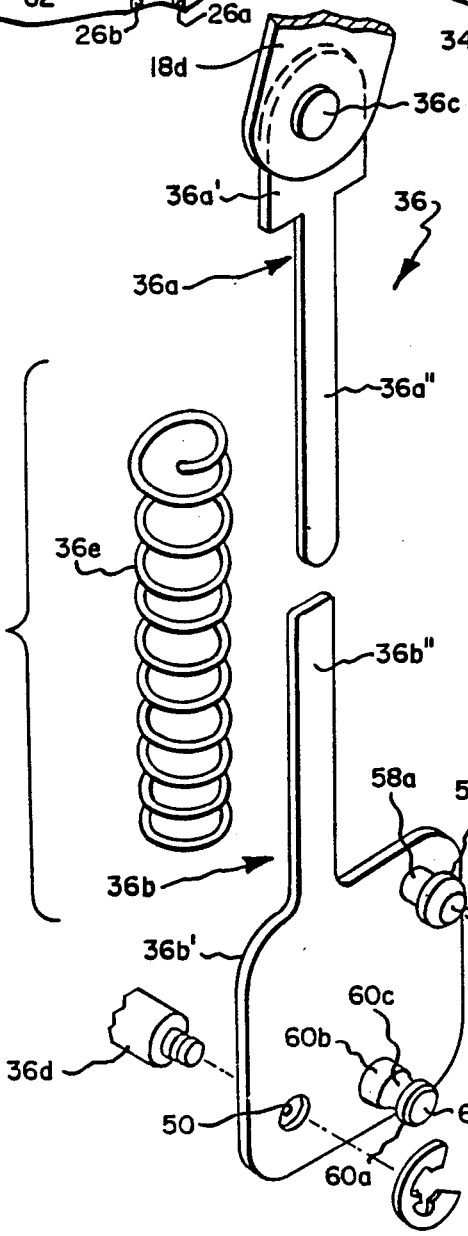
Fig. 6.
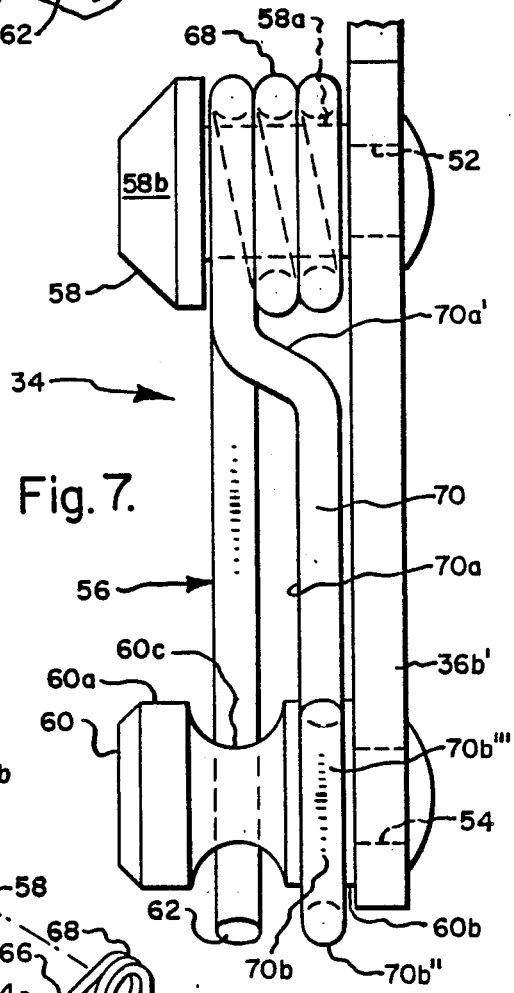
Fig. 7.

COIN HOLDING MECHANISM FOR COIN OPERATED LOCKER

BACKGROUND OF THE INVENTION

The present invention relates to coin operated locks of the type first described in U.S. Pat. Nos. 3,193,074 and 3,228.506.

In prior commercial coin operated lock units of the type described in these patents, a coin gauging lever is supported on a side wall of the coin chute for pivotal movements between coin gauging and release positions. When in gauging position, the lever cooperates with a front edge of a coin chute or other suitably defined gauging surface to gauge the size of coins deposited in the coin chute and to temporarily support a properly sized coin(s) in a coin sensing position or station, wherein it can be sensed by a coin feeler finger, which thereupon frees a patron key controlled lock for rotation from its unlocked position into its locked position. Rotation of the patron lock into its locked position or subsequent removal of the patron key from the patron lock, which can only occur when the patron lock is in its locked position, frees the coin gauging lever for pivotal movement into a release position permitting the previously sensed coin to fall by gravity into a temporary storage position defined by a coin holding pawl for the case where the lock unit is adjusted to render "free" service or for discharge from the lock unit into a coin collection box for the case where the lock unit is adjusted to render "prepaid" service; in either case the lever thereafter being forced to return to its gauging position as an incident to the return of the patron lock to its unlocked position or reinsertion of the patron key. When the lock unit is adjusted to render "free" service, the coin holding pawl is withdrawn from its operative or coin holding position within the coin chute, as an incident to return of the patron lock into its unlocked position, to allow for discharge of the coin from the temporary storage position for return to a patron via a coin return or discharge slot formed in the front plate of the lock unit.

A drawback of these prior lock units is that when they are adjusted to render "free" service, it is possible to effect withdrawal of the coin holding pawl from the coin chute sufficiently to permit discharge of a coin from its temporary storage position for return to the patron, during an initial stage of unlocking rotary movement of the patron lock, which is completed slightly before the patron lock is rotated through an arc sufficient to render operable a latch mechanism defined by the patron lock and coin gauging lever otherwise serving to prevent return movement of the patron lock to its locked position until another coin is subsequently deposited in the lock unit. As a result, a vandal, after once having had his coin deposit returned, can return the patron lock to locked position and remove the patron key as a trophy. The loss of the patron key renders the locker unusable until such time as a custodian can gain access to the lock unit for purposes of replacement of the patron key/patron lock assembly.

SUMMARY OF THE INVENTION

The present invention is directed to an improved coin holding mechanism equally adapted for use in new lock units and in retrofitting of previously installed lock units of the general type described in U.S. Pat. Nos. 3,193,074 and 3,228,506 to prevent return of a coin deposit to a patron until after the patron lock has been rotated sufficiently away from its locked position in order to permit the latch mechanism defined by the patron lock and coin gauging lever to become effective for purposes of preventing return of the patron lock to its locked position until another coin is placed on deposit within the lock unit.

BRIEF DESCRIPTION OF THE DRAWINGS

The nature and mode of operation of the present invention will now be more fully described in the following detailed description taken with the accompanying drawings wherein:

FIG. 1 is a fragmentary front elevational view of a bank of checking lockers employing lock units of the present invention;

FIG. 2 is a side elevational view of a lock unit of the present invention;

FIG. 3 is a view taken generally along the line 3—3 in FIG. 2;

FIGS. 4 and 5 are fragmentary views similar to FIG. 3, but showing the coin holding mechanism in successive positions assumed incident to rotation of the patron lock towards its locked position;

FIG. 6 is an exploded perspective view of the coin holding and over center mechanisms; and FIG. 7 is an enlarged fragmentary view taken generally along the line 7—7 in FIG. 3.

DETAILED DESCRIPTION

Reference is first made to FIG. 1, wherein a lock unit formed in accordance with the present invention is generally designated as 10 and shown as being mounted within the frame of a typical coin operated locker cabinet designated as "L". Cabinet "L" may include one or more upright lock unit mounting posts 12, which cooperate with each other and/or a hinge mounting posts **12*a* to horizontally bound one or more columns of storage compartments "C", wherein the compartments of each column are vertically separated by horizontal frame members "F" extending between such posts. The forwardly facing access openings of the storage compartments are selectively closed by suitable doors "D", which are hingedly secured to the hinge mounting posts or to intermediate ones of the lock unit mounting posts for instances where the locker cabinet is provided with more than one column of storage compartments, and selectively and releasably secured in locked or storage compartment closed condition by associated ones of lock units 10. Each door "D" is provided with a handle "H" for use in moving same between storage compartment open and closed condition and for use in freeing lock unit 10** for door locking purposes.

Lock unit 10 is similar in construction to lock units disclosed in U.S. Pat. Nos. 3,193,074 and 3,228,506 whose disclosures are specifically incorporated by reference herein. However, to facilitate description of the present invention and understanding of the difference between same and these prior lock units, lock unit 10 will be generally described as including a front or mounting plate 14, which is provided with apertures, not shown, to receive the forwardly projecting ends of a key operated custodian lock 16, a key operated patron lock 18 and a patron lock release rod 10; a slot 22 serving to define a coin insertion slot whose effective size may be reduced, as desired, by a removably inserted blocking plate to prevent insertion into the lock unit of coins exceeding the diameter of a given coin of a selected currency intended for use in operating the lock unit; and a return slot 22*a* through which a coin may be returned to a patron when the lock unit is adjusted to render "free" service.

Front plate 14 additionally serves to mount a vertically extended open ended coin chute 26, whose upper and lower ends are arranged in communication with coin insertion slot 22 and return slot 22*a*, respectively; a bracket 28, which serves to slidably support a lock bolt 30 for reciprocating movement between its retracted or unlocked position and an extended or locked position incident to movement of patron lock 18 between its unlocked and locked conditions shown in FIGS. 3 and 5, respectively; a spring biased, pivotally supported coin gauging lever 32 having at one end a coin feeling or sensing finger 32*a* and at its opposite end a latch pawl 32*b* arranged to removably engage with latch or ratchet teeth 18*a* and 18*b* carried by a disc 18*c* fixed for rotational movement with patron lock 18; and a coin holding mechanism 34 forming part of a spring biased overcenter mechanism 36 employed to alternatively bias patron lock 18 into its locked and unlocked positions. Lock unit 10 may be releasably retained within a mounting opening, not shown, provided in mounting post 12, by a bottom lip 14*a* formed integrally with front plate 14 and a latch plate 16*a* carried by custodian lock 16.

Coin chute 26 is shown for example as being defined by a generally U-shaped bracket having outer and inner plate portions 26*a* and 26*b* and upper and lower rear connecting flange portions 26*c* and 26*c*'. Plate portions 26*a* and 26*b* are arranged in parallel relationship and spaced one from another to insure that coins inserted through aperture 22 pass downwardly on edge through the coin chute to exit either vertically through the lower end of the coin chute for collection within a coin collection box, not shown, associated with mounting post 12 or for return to the patron via return aperture 22*a* depending upon the position of a coin passage blocking bar 40 supported within coin chute 26 by threaded fasteners selectively received within two pairs of apertures 40*a* and 40*b* formed in coin chute plate portion 26*b*. In the drawings, blocking bar 40 is shown as being arranged to block the lower end of coin chute 26 and direct coins forwardly for discharge through coin return slot 22*a*. Rear flange portions 26*c*, 26*c*' and a front flange portion, not shown, formed integrally with inner plate portion 26*b* serve to define rear and front edges of the coin chute. Inner side plate portion 26*b* is cut away to define openings 26*e*, 26*f* and 26*g* affording access to the interior of coin chute 26.

In prior lock units, a coin inserted into slot 22 is releasably retained at the sensing station by cooperation of a stationary gauging surface, such as that defined by a front surface of coin chute 26, and a coin gauging-/retaining mechanism, which may be of the type defined by a lever 44 carrying a gauging element or coin intercepting finger 44*a* arranged to project into coin chute 26 through opening 26*e* and is in turn pivotally supported on the coin chute by a mounting pin 44*b* for movement under the control of patron lock 18 between coin gauging position shown in FIG. 2 and coin release position, not shown. Further, as in the case of certain of these prior lock constructions, lever 44 may be operably coupled to or be placed under the control of patron lock 18 by forming its upper end to define a follower finger 44*c* arranged to slidably engage with a patron lock barrel affixed plate 18*d* having a forwardly inclined cam or release surface 18*e*; the planar rear surface of plate 18*d* cooperating with a coin chute mounted stop 26*h* to normally retain the lever in its coin gauging position shown in FIG. 2 and cam surface 18*e* permitting counterclockwise directed pivotal movements of the lever into its release position, as viewed in FIG. 2, due to the weight of the previously sensed coin acting against gauging element 44*a*. Alternatively, lever 44 may be otherwise coupled to or be placed under the control of patron lock 18, as for instance by replacing finger 44*c* with a spring device, not shown, which is arranged to engage a patron key ejection pin 18*f* slidably supported by patron lock barrel, not shown, with its forward end arranged to engage with the inserted end of the patron key; such construction being characterized in that the lever spring device acts through pin 18*f* to automatically eject the patron key upon placement of the patron lock in its locked condition and in that the forwardly directed ejecting movement of the pin permits pivotal movement of the lever into its release position. A more detailed description of these alternative modes of coupling the lever to the patron lock may be had by referring to U.S. Pat. No. 3,599,770. Also, the coin gauging-/retaining mechanism may be otherwise formed such as in the manner depicted in U.S. Pat. No. 4,153,150 where it is desired to require the insertion of more than one coin to operate lock unit 10.

Further, in these prior lock units, overcenter mechanism 36 typically comprised a pair of elements 36*a* and 36*b* having their remotely disposed ends or mounting portions 36*a*'and 36*b*'pivotally connected to patron lock affixed plate 18*d* and front plate 14 by pivot pin devices 36*c* and 36*d*, respectively, and their adjacently disposed ends or slide portions 36*a*'' and 36*b*'' maintained in sliding, essentially aligned relationship by an enclosing coil type counterbalance spring 36*e*. In prior lock units, mounting end 36*b*' was formed with a heart shaped or double lobed recess, not shown, into whose opposite ends or lobes pivot pin device 36*d* could be removably snap fitted for purposes of adjusting element 36*b* to alternatively pivot about two parallel axes in order to render "free" or "prepaid" service. In one of such pivotal positions or the "free" pivotal position, a coin holding finger formed as an integral extension of mounting end 36*b*' and comprising the coin holding mechanism of the lock unit was positioned to be removably inserted into coin chute 26 through aperture 26*f* for purposes of cooperating with the upper edge of rear connecting flange portion 26*c*' to retain a coin in a temporary storage position after same had been discharged to pass downwardly from the coin sensing station. In the other of such pivotal positions or the "prepaid" pivotal position, the coin holding finger was maintained in a retracted position related to coin chute 26 for all rotatable positions of patron lock 18.

An operational cycle of prior lock units of the type described is initiated when lock unit 10 is in an unlocked condition, i.e. patron lock 18 is disposed in its unlocked position shown in FIG. 2, wherein the patron key is captured within the patron lock and lock bolt 30 is fully retracted to permit door "D" to be opened and closed for purposes of allowing a possession(s) of a patron to be inserted into storage compartment "C". Upon closing of door "D", patron lock release rod 20 is automatically depressed to free patron lock 18 for rotation towards its locked position in a counterclockwise direction, as viewed in FIG. 3. However, rotation of patron lock 18 into its locked position is prevented until such time as a predetermined coin(s) is deposited within coin chute 26 and supported at the coin sensing station by coin gauging/retaining lever 44, due to the presence of coin feeling lever 32 which is spring biased for pivotal movement in a clockwise sense, as viewed in FIG. 3, such that its latch pawl 32*b* is biased into engagement with the peripheral edge or rim of disc 18*c*. Upon initiation of rotation of patron lock 18 towards its locked position, latch pawl 32*b* is biased to ride into a latch recess 18*a*' leading to latch tooth 18*a*. When no coin is disposed in the sensing station, latch pawl 32*b* continues to ride into latch recess 18*a*' as patron lock 18 is rotated until it reaches a depth at which it is arranged to engage with latch tooth 18*a* to constrain further rotation of the patron lock. On the other hand, when a coin is disposed in the coin sensing station, coin sensing finger 32*a* extends through chute aperture 26*g* and engages with the coin to block latch pawl 32*b* from riding into latch recess 18*a*' to a depth at which it can engage with latch tooth 18*a* or subsequently with latch tooth 18*b*. As a result, a patron lock 18 is freed to rotate into its fully locked position for purposes of fully extending lock bolt 30, as shown in FIG. 5.

As patron lock 18 nears its locked position, coin gauging/retaining lever 44 pivots to release a previously deposited coin from the sensing station to either permit gravity discharge of such coin from lock unit 10 for receipt within a collection box, not shown, when the lock unit is in a "prepaid" service condition or gravity induced fall of such coin into a temporary storage position when the lock unit is in a "free" service condition. In the "free" service condition of lock unit 10, blocking bar 40 is arranged in its position shown in FIG. 2 and the previously referred to coin holding finger is pivoted into coin chute 26 for purposes of supporting a coin in the temporary storage position immediately prior to release of a coin from the coin sensing station, which in turn occurs almost simultaneously with placement of patron lock 18 in its locked position.

Upon arrival of patron lock 18 in its locked position, a locking portion of the operational cycle of lock unit 10 is completed and the patron key is freed by the tumblers associated with its lock cylinder, not shown, for removal from the patron lock by a patron and door "D" is in a closed and locked condition.

The final stage or unlocking portion of the operational cycle of lock unit 10 is initiated by reinserting the patron key in patron lock 18 and then using such key to impart clockwise directed rotational movement to the patron lock, as viewed in FIG. 3, for purposes of returning same to its initial unlocked position. During such return movement, coin gauging/retaining lever 44 is forced to pivot for return to its initial gauging position and latch pawl 32*b* is permitted to ratchet relative to latch teeth 18*b* and 18*a* with the latch pawl eventually riding out of recess 18*a*' to withdraw coin sensing finger 32 from within coin chute 26 incident to return of patron lock 18 to its unlocked position. It will be understood that immediately after latch pawl 32*b* ratchets over latch tooth 18*b*, the spring bias exerted on coin feeling lever 32 causes the latch pawl to enter a latch recess 18*b*' disposed between latch teeth 18*b* and 18*a*. When this occurs, patron lock 18 is committed for return to its unlocked position; that is, the patron lock cannot be subsequently moved towards its locked position until a subsequently deposited coin is arranged in the coin sensing station for purposes of maintaining the latch pawl in a position disposed radially outwardly of the latch teeth. However, it has been discovered that with these prior lock units, the previously referred to coin holding finger, when in a "free" service condition, is removed from coin chute 26 slightly prior to the point in time when latch pawl 32*b* ratchets over latch tooth 18*b* into latch recess 18*b*', thereby permitting discharge of a coin from the temporary storage position for return to the patron prior to the time at which patron lock 18 is committed for return to its unlocked position. Thus, it is possible for a vandal by imparting slow and carefully controlled rotation to patron lock 18 to retrieve the coin deposit and then return the patron lock to its locked position, whereat the patron key can be removed and retained for purposes of rendering lock unit 10 and associated storage compartment "C" inoperative for subsequent use until installation of a new lock unit and associated patron key. Attempts to overcome this problem by repositioning latch tooth 18*b* have not met with success, due to the small arc of return rotational movement of patron lock 18 required to extract the coin holding finger from coin chute 26 sufficiently to free a coin disposed for discharge from the temporary storage position.

In accordance with the present invention, the drawback of prior lock units of the type described is overcome by providing new locks units or retrofitting previously installed lock units with the improved coin holding mechanism 34 depicted in the drawings. The presently preferred form of new mechanism 34 makes use of the prior overcenter mechanism 36, except that the above described element 36*b* is replaced by a newly shaped or designed element or part 36*b* whose mounting portion 36*b*' is formed with a cylindrical bore opening 50 for receiving pivot pin device 36*d*, whereby such mounting portion is constrained to pivot relative to front plate 14 about single pivot axis, and a pair of additional bore openings 52 and 54 shown only in FIG. 7. Further, the rigid, integrally formed coin holding finger of the prior lock units is replaced by a resiliently deformable, coin holding spring 56 supported/positioned on mounting portion 36*b*'by a spring attachment pin 58 and a spring holding pin 60, which are fixed within bore openings 52 and 54, respectively. Spring 56 is best shown in FIGS. 6 and 7 as being formed from spring wire of circular cross-section and as being shaped to define a first free end portion 62, which is bowed or bent intermediate its length to provide it with a flat "V" shaped configuration; a first or bearing coil portion 64 preferably comprising two or more turns; a generally straight first connecting portion 66; a second or mounting coil portion 68 preferably comprising two or more turns; and a second or opposite free end portion 70, which is preferably comprised of a generally straight section 70*a* connected to the second coil portion by an offset or stepped area 70*a*' and a somewhat rounded end section 70*b* formed by providing smooth bend areas 70*b*', 70*b*' and 70*b*'''. It will be understood by viewing FIGS. 3, 6 and 7, that spring 56 has a generally U-shaped plan view configuration, wherein connecting portion 66 and sections 70*a* and 70*b* are essentially coplanar and disposed parallel to a plane in which first free end portion 62 is disposed, and that coil portions 64 and 68 are of essentially like size and have their axes arranged essentially parallel and normal to the planes in which portions 62 and 66 and sections 70*a* and 70*b* are disposed.

Again referring to FIG. 7, it will be noted that attachment pin 58 is formed with a shank portion 58*a* arranged to upstand from mounting portion 36*b'* and sized to freely journal second coil portion 68 for rotational movement about an axis disposed parallel to the mounting portion pivot axis defined by pin 36*d* and an enlarged head portion 58*b* arranged to overlie the second coil portion and maintain same closely adjacent the mounting portion. It will also be noted that holding pin 60 is formed with a generally cylindrical side surface divided into axially spaced parts 60*a* and 60*b* by a concave, annular guide/retaining recess 60*c* sized to freely receive first free end portion 62. The arrangement is such that when spring 56 is attached to mounting portion 36*b'* by attachment pin 58 and such mounting portion is pivotally supported on front plate 14 by pivot pin 36*d*, first end portion 62 and second end portion 70 are arranged on opposite sides of holding pin 60 with the second end portion being disposed in alignment with coin chute aperture 26*f*, and first coil portion 64 is arranged for engagement by the lower or free end of slide portion 36*a''*, which assumes the additional function of being a "driver" for effecting resilient deformation of spring 56 in the manner to be described. Spring 56 tends to assume or return to an initial configuration shown in FIG. 3, wherein it is in an essentially unstressed state or stressed only to the extend necessary to maintain free end portions 62 and 70 in surface-to-surface contact with opposite sides of holding pin 60; and end section 70*b*, which is to serve as a coin holding portion, is withdrawn from the confines of coin chute 26 or at least to that degree sufficient to permit free passage of coins downwardly therethrough.

By again viewing FIG. 3, it will be understood that in the unlocked position of patron lock 18, overcenter mechanism 36 assumes a first limiting condition, wherein spring 36*e* tends to maintain element slide portions 36*a''* and 36*b''* in an aligned condition and is under a minimum compressive stress sufficient to bias the patron lock to assume its unlocked position and insure that lock bolt 30 is fully retracted. In this limiting condition, the free or driving end of slide portion 36*a''* is spaced from engagement with first coil portion 64 and, as previously noted, spring 56 is permitted to reside in its initial configuration.

Reference is now made to FIG. 4, which depicts the condition of parts of lock unit 10 upon rotation of patron lock 18 to a position in which latch pawl 32*b* would engage with latch tooth 18*a* for purposes of blocking continued rotational movement of the patron lock towards its locked position in the absence of a coin being supported in the coin sensing station by lever 44. During rotation of patron lock 18 between the positions shown in FIGS. 3 and 4, overcenter mechanism 36 is forced to move from its first limiting condition towards its centered condition, which does not in fact occur until movement of the patron lock intermediate the positions thereof shown in FIGS. 4 and 5, and as an incident thereto spring 36*e* is progressively compressed and the free or driving end of slide portion 36*a''* is forced to move progressively towards pivot pin 36*d* with the result that such free end engages first coil portion 64 and then effects deformation of spring 56 for the purpose of driving end section 70*b* into coin chute 26 for engagement with outer plate portion 26*a*. It will be understood that with the illustrated construction, end portion 70*b* is actually brought into engagement with the inner surface of outer plate portion 26*a* within the five to fifteen degrees of arcuate movement of the patron lock 18 occurring prior to arrival thereof in its rotational position shown in FIG. 4, such that end portion 70*b* becomes effective for coin holding or supporting purposes prior to the point at which latch pawl 32*b* and latch tooth 18*a* become effective for patron lock rotation blocking or latching purposes. The forces acting on overcenter mechanism 36 and holding mechanism 34, during movement of patron lock 18 into its rotational position shown in FIG. 4, are such that slide portion 36*a''* is caused to tilt relative to slide portion 36*b''*; mounting portion 36*b'* is caused to rotate slightly in a clockwise sense, as viewed in FIG. 4; and end portion 70*b*, after having been first brought into initial engagement with outer plate portion 26*a* is caused to slide downwardly along the outer plate portion through a short, but visually discernible distance. The rotational position of patron lock 18 shown in FIG. 4 is unstable, and if manually operating pressure would be removed from the key of the patron lock at this point, overcenter mechanism 36 would automatically function to return the patron lock to its unlocked position, thereby allowing spring 56 to resiliently return to its initial configuration. This unstable condition of patron lock 18 continues until the centered condition of overcenter mechanism 36 is reached, whereafter the overcenter mechanism automatically functions to drive the patron lock into the locked position of FIG. 5. For purposes of reference, it will be noted that the centered condition of overcenter mechanism 36 occurs approximately at that portion of the rotational cycle of patron lock 18, wherein latch pawl 32*b* is arranged to project into latch recess 18*b'* for cooperation with latch tooth 18*b* for purposes of preventing return rotation of the patron lock towards its locked position until after deposit of a subsequent coin within lock unit 10. As rotation of patron lock 18 continues beyond its position shown in FIG. 4 towards that shown in FIG. 5, the free end of slide portion 36*a''* continues to move towards pivot pin 36*d*, until the centered condition of overcenter mechanism 36 is achieved, and then retreats relative to such pivot pin, until the locked position of patron lock 18 is achieved. During an initial position of such movement of slide portion 36*a''* beyond shown in FIG. 4, its free end rides off of first coil portion 64, such that during the remaining portion of the movement of the slide portion, its edge, rather than its free end, is disposed in engagement with the first coil portion, as depicted in FIG. 5. This limits the displacement or extent of deformation of first coil portion 64, due to its engagement by slide portion 36*a''*, and as a result provides for a controlled maximum tension condition to which the first coil portion may be exposed. Also, it will be noted that, as a result of rotation of patron lock 18 beyond its position shown in FIG. 4, mounting portion 36*b'* is caused to continue clockwise rotational movement until it reaches the position shown in FIG. 5. As a result of this rotational movement of mounting portion 36*b'*, end portion 70*b* is caused to slide further downwardly along the inner surface of outer plate portion 26*a*, until it reaches its final coin holding position depicted in FIG. 5.

By means of the present construction of coin holding mechanism 34, a coin used to operate lock unit 10 is retained in a temporary storage position throughout a substantial extent of rotational movement of patron lock 18 from its locked position towards its unlocked position with end portion 70*b* being removed from coin chute 26 to permit return of such coin to a patron only after the patron lock has been rotated sufficiently to permit latch pawl 32*b* to ratchet past both of latch teeth 18*b* and 18*a*. As a result, latch tooth 18*b* could be eliminated in new lock units incorporating the present invention. In any case, it is impossible to discharge a previously deposited coin to a patron, while the lock unit remains free of constraint against return to its locked position for key removal purposes.

An additional advantage of the present coin holding mechanism 34 is that it can be installed in any lock unit regardless of whether same is initially intended for "free" or "prepaid" service. In this respect, it will be understood that a lock unit having mechanism 34 installed in the manner depicted in the drawings, so as to initially provide for "free" service operation, may be changed to provide for "prepaid" service operation by simply dismounting part 36*b* from pivot pin 36*d* and then remounting part 36*b* on the pivot pin such that spring 56 faces towards front plate 14; the part thereafter functioning solely as part of overcenter mechanism 36.

While coin holding mechanism 34 has been described as being formed as an integral part of overcenter mechanism 36, it is anticipated that it is not so limited, since a required degree of deformation of spring 56 could be achieved by non-movably mounting pins 58 and 60 directly on front plate 14 and employing any suitable driver, including element 36*a*. This construction is not preferred, however, since it would require redesign of the interior of the lock unit and would not be suitable for the retrofitting of existing lock units.

I claim:

1. A coin operated lock unit of the type having free service operation comprising:

a key operated patron lock;

means for supporting said patron lock for rotation between unlocked and locked positions;

a vertically extending coin chute communicating with coin insertion means and coin discharge means arranged adjacent upper and lower ends thereof, respectively;

coin gauging means for releasably supporting a given diameter coin inserted into said coin chute through said insertion means at a coin sensing station disposed within said coin chute vertically intermediate said insertion means and discharge means;

coin sensing means for sensing the presence of said coin at said sensing station;

latch means operable for preventing rotation of said patron lock into said locked position in the absence of said coin at said sensing station, said gauging means being responsive to rotation of said patron lock into said locked position for releasing said coin from said sensing station for gravity discharge towards said discharge means; and coin holding means for removably supporting said coin in a temporary storage position after said coin is released from said sensing station and for subsequently releasing said coin from said temporary storage position for discharge from said lock unit through said discharge means during rotation of said patron lock towards said unlocked position after said latch means becomes operable for preventing rotation of said patron lock towards said locked position in the absence of said coin at said sensing station, said coin holding means including a spring supported for movement relative to said coin chute, said spring having an initial configuration, wherein it is withdrawn sufficiently from said coin chute to permit release of said coin from said temporary storage position, and driver means operable in response to rotation of said patron lock towards said locked position for effecting deformation of said spring from said initial configuration against the resilient bias thereof to assume a deformed configuration, wherein it is inserted within said coin chute for purposes of removably supporting said coin in said temporary storage position, said bias tending to return said spring to said initial configuration, and said driver means maintains said spring in said deformed configuration at least until said latch means becomes operable.

2. A lock unit according to claim 1, wherein said driver means has one end pivotally connected to said patron lock, said spring is carried by an element pivotally supported by said means supporting said patron lock, said driver means having an opposite end arranged to engage said spring, and said driver means and said element are operatively associated with a spring device and cooperate to define an overcenter mechanism tending to alternatively bias said patron lock towards said unlocked and locked positions.

3. A lock unit according to claim 2, wherein said element carries an attachment pin for attaching said spring to said element and a spring holding pin, said spring is of a generally U-shaped configuration comprising a first free end portion, a first coil portion connected to said first free end portion, a second coil portion encircling said attachment pin and joined to said first coil portion by a connecting portion and a second free end portion joined to said second coil portion, said spring holding pin being disposed intermediate said first free end portion and said second free end portion and engaging with said first free end portion during deformation of said spring between said initial configuration and said deformed configuration, and said opposite end of said driver means engages said first coil portion to deform said spring from said initial configuration to removably insert said second free end portion into said coin chute to releasably support said coin in said temporary storage position.

4. A lock unit according to claim 1, wherein said driver means has one end operably connected to said patron lock and an opposite end; said spring includes a first free end portion, a first coil portion connected to said first free end portion, a second coil portion joined to said first coil portion by a connecting portion and a second free end portion joined to said second coil portion; spring attachment means is provided for journalling said second soil portion for rotation about an axis relative to said means supporting said patron lock; and spring holding means is positionally fixed relative to said axis and disposed intermediate said first free end portion and said second free end portion, said first free end portion engaging with said holding means during deformation of said spring between said initial configuration and said deformed configuration, and said opposite end of said driver means engaging said first coil portion to deform said spring from said initial configuration to removably insert said second free end portion into said coin chute to releasably support said coin in said temporary storage position.

5. A lock unit according to claim 4, wherein said attachment means and said spring holding means are carried by an element pivotally supported by said means supporting said patron lock, and spring means cooperates with said element and said driver means to define an overcenter mechanism for alternatively biasing said patron lock towards said unlocked and locked positions from a position intermediate said positions.

6. An improved coin holding mechanism for use within a coin operated lock unit of the type adapted for free service operation and having a patron lock; means for supporting said patron lock for rotation between an unlocked position and a locked position, said patron lock having latch part means and a patron lock manipulating key fixed within said patron lock for all rotational positions thereof other than said locked position; a vertically extending coin chute communicating with coin insertion means and coin discharge means disposed in communication with upper and lower ends thereof, respectively; a coin gauging means for releasably supporting a given diameter coin inserted within said coin chute at a coin sensing station vertically intermediate said coin insertion means and coin discharge means; means for sensing the presence of said coin in said sensing station and including latch part means cooperation with said latch part means of said patron lock for preventing rotation of said patron lock from said unlocked position in the direction of said locked position in the absence of a coin supported in said sensing station, said coin gauging means being operable in response to rotation of said patron lock into said locked position for releasing said coin from said coin sensing station for gravity discharge thereof towards said lower end of said coin chute; and an overcenter spring and coin holding mechanism for alternatively biasing said patron lock for rotation towards said unlocked and locked positions from a point intermediate said positions, said overcenter spring and coin holding mechanism including in part a first element having one end pivotally supported by said patron lock and a second end, pivot means carried by said means supporting said patron lock and a spring, said second end of said first element moving relatively towards and away from said pivot means during rotation of said patron lock between said unlocked and locked positions, said improved coin holding mechanism comprising a second element of said overcenter spring and coin holding mechanism and including: a part having a first end adapted to be removably pivotally supported by said pivot means and a second end adapted for association with said second end of said first element and to be encircled therewith by said spring, said first end of said part mounting attachment means and holding means; and a spring device, said spring device having a first free end portion, a first coil portion joined to said first free end portion, a second coil portion joined to said first coil portion by a connecting portion and a second free end portion joined to said second coil portion, said attachment means journalling said second coil portion, said first and second free end portions being arranged on opposite sides of said holding means, and said first coil portion is disposed in a position in which it is engaged by said second end of said first element during movement thereof towards said pivot means to effect deformation of said spring device against the bias thereof and force said second free end portion into said coin chute to releasably retain said coin in said temporary storage position, and said bias tends to withdraw said second free end portion from within said coin chute upon movement of said second end of said first element away from said pivot means.

7. In a coin operated lock unit of the type adapted for free service operation and having a coin holder inserted into and withdrawn from a coin chute incident to rotation of a patron lock from an unlocked position into a locked position and from said locked position into said unlocked position, respectively, for purposes of removably supporting a coin deposit in a temporary storage position after the presence of said coin has been sensed by a coin sensing means of said lock unit during rotation of said patron lock towards said locked position, and means adapted to prevent return rotation of said patron lock to said locked position after a given rotational displacement thereof from said locked position towards said unlocked position until insertion into said lock unit of a subsequent coin deposit, an improved coin holder for preventing withdrawal thereof from said coin chute resulting in release of said coin deposit from said temporary storage position for discharge thereof from said lock unit until after said given rotational displacement of said patron lock comprising: a spring having a coin holding portion and tending to assume an initial configuration wherein said coin holding portion thereof is withdrawn from said coin chute sufficiently to permit release of said coin deposit from said temporary storage position, and driver means operable in response to rotation of said patron lock towards said locked position to effect deformation of said spring from said initial configuration against the resilient bias thereof to force said coin holding portion into said coin chute for purposes of removably supporting said coin deposit in said temporary storage position, and said driver means maintains said coin holding portion within said coin chute until after said given rotational displacement, whereupon said spring is permitted to return to said initial configuration under said bias at or before rotation of said patron lock into said unlocked position.

* * * * *

UNITED STATES PATENT AND TRADEMARK OFFICE

CERTIFICATE OF CORRECTION

PATENT NO. : 4,844,228

DATED : July 4, 1989

INVENTOR(S) : Douglas A. Barth

It is certified that error appears in the above-identified patent and that said Letters Patent is hereby corrected as shown below:

Col. 2, line 65 - "10" should be -- 20 --.

Col. 4, line 55 - "related" should be -- relative --.

Col. 5, line 22 - after "result," delete -- a --.

Col. 6, line 59 - the second occurrence of "70b' " should be -- 70b'' --.

Col. 8, line 44 - after "beyond" insert -- the position --.

Col. 10, line 52 - "soil" should be -- coil --.

Signed and Sealed this

Twenty-fourth Day of July, 1990

*Attest:*

HARRY F. MANBECK, JR.

*Attesting Officer*

*Commissioner of Patents and Trademarks*